US006452329B1

(12) United States Patent
Jang

(10) Patent No.: US 6,452,329 B1
(45) Date of Patent: Sep. 17, 2002

(54) VACUUM FLUORESCENT DISPLAY FOR MINIMIZING NON-USE AREA

(75) Inventor: Chul-Hyun Jang, Kyungsangnam-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 09/454,652

(22) Filed: Dec. 6, 1999

(30) Foreign Application Priority Data

Dec. 8, 1998 (KR) ..... 98-53656

(51) Int. Cl.[7] ..... H01J 1/62; H01J 63/04

(52) U.S. Cl. ..... 313/495; 313/497; 313/513; 313/519; 313/271

(58) Field of Search ..... 313/495, 496, 313/497, 274, 271, 272, 273; 445/25

(56) References Cited

U.S. PATENT DOCUMENTS 3,800,178 A * 3/1974 Farina ..... 313/497
3,986,760 A * 10/1976 Kishino ..... 445/25
4,004,186 A * 1/1977 Bylander ..... 313/494
5,204,583 A * 4/1993 Jeong ..... 313/474

* cited by examiner

*Primary Examiner*—Ashok Patel
*Assistant Examiner*—Mariceli Santiago
(74) *Attorney, Agent, or Firm*—Christie, Parker & Hale, LLP

(57) ABSTRACT

A vacuum fluorescent display includes first and second substrates spaced apart from each other with a predetermined distance. Each substrate has lateral sides in horizontal and vertical directions. A plurality of anode electrodes are arranged on the second substrate in a predetermined pattern. The anode electrodes are coated with phosphors. A plurality of filaments are mounted above the anode electrodes to emit thermal electrons for exciting the phosphors. A plurality of leads are arranged on one of the opposite lateral sides of the second substrate in one of the horizontal and vertical directions to apply voltages to the anode electrodes. Supports are arranged on both of the opposite sides of the second substrate in the direction of arrangement of the leads to support the filaments.

1 Claim, 5 Drawing Sheets

VACUUM FLUORESCENT DISPLAY FOR MINIMIZING NON-USE AREA

BACKGROUND OF THE INVENTION (a) Field of the Invention

The present invention relates to a vacuum fluorescent display and, more particularly, to a vacuum fluorescent display which can effectively increase the area of displaying images.

(b) Description of the Related Art

Vacuum fluorescent displays are display devices where electrons are liberated from the cathode and strike phosphors coated on the anode to create display images. Such a vacuum fluorescent display is capable of producing multi-colored images with a low voltage, and is well adapted to the semiconductor device appliances. Therefore, the vacuum fluorescent displays are attracted for various display purposes.

FIG. 6 is an exploded perspective view of a vacuum fluorescent display according to a prior art, FIG. 7 is a plan view of the vacuum fluorescent display shown in FIG. 6, and FIG. 8 is a sectional view of the vacuum fluorescent display taken along the F—F line of FIG. 7.

As shown in the drawings, the vacuum fluorescent display includes a transparent front glass substrate 2, a rear glass substrate 4 spaced apart from the front glass substrate 2 with a predetermined distance, and a side glass 3 interposed between the front glass substrate 2 and the rear glass substrate 4 while forming an inner vacuum space for receiving electrode components. The front glass substrate 2 and the rear glass substrate 4 are rectangular-shaped each with two long sides and two short sides.

A plurality of anode electrodes 8 are arranged on the rear glass substrate 4 in a predetermined pattern, and coated with phosphors. The display area D corresponds to the pattern of the anode electrodes 8.

A plurality of grids 7 are mounted above the anode electrodes 8, and a plurality of filaments 6 are placed above the grids 7 to function as electron-emitting cathode electrodes. Each of the grids 7 has side bent portions, and the side bent portions of the grid 7 are fixed to the rear glass substrate 4 such that the grid 7 can be spaced apart from the anode electrodes 8 with a predetermined distance. A plurality of leads 9 are fixed onto one of the long sides of the rear glass substrate 4 to apply voltages to the grids 7 and the anode electrodes 8.

Each of the filaments 6 has two ends, and the ends of each filament 6 are fixed to supports 10 on the rear glass substrate 4, respectively. The supports 10 are fixed onto both of the short sides of the rear glass substrate 4. In this structure, the filaments 6 are arranged to be perpendicular to the leads 9.

The filaments 6 are welded to the supports 10 at welding points. In operation, the side portions of each filament 6 sustain thermal loss through the welding points. Therefore, the side portions of the filament 6 close to the welding points do not emit sufficient amount of thermal electrons for exciting the phosphors on the anode electrodes 8. The area C corresponding to such side portions of the filament 6 is usually referred to as the "end cooling zone".

In the above-structured vacuum fluorescent display, the leads 9 and the supports 10 for supporting the filaments 6 are oriented at the sides of the rear glass substrate 4 different in direction so that the end cooling zones C are present in relatively large areas over the display device. This means that the display area D of the vacuum fluorescent display decreases as much.

SUMMARY OF THE INVENTIONs

It is an object of the present invention to provide a vacuum fluorescent display which increases the display area while minimizing the end cooling zones.

These and other objects may be achieved by a vacuum fluorescent display including first and second substrates spaced apart from each other with a predetermined distance. Each substrate has lateral sides in horizontal and vertical directions. A plurality of anode electrodes are arranged on the second substrate in a predetermined pattern. The anode electrodes are coated with phosphors. A plurality of filaments are mounted above the anode electrodes to emit thermal electrons for exciting the phosphors. A plurality of leads are arranged on one of the opposite lateral sides of the second substrate in one of the horizontal and vertical directions to apply voltages to the anode electrodes. Supports are arranged on both of the opposite sides of the second substrate in the direction of arrangement of the leads to support the filaments.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
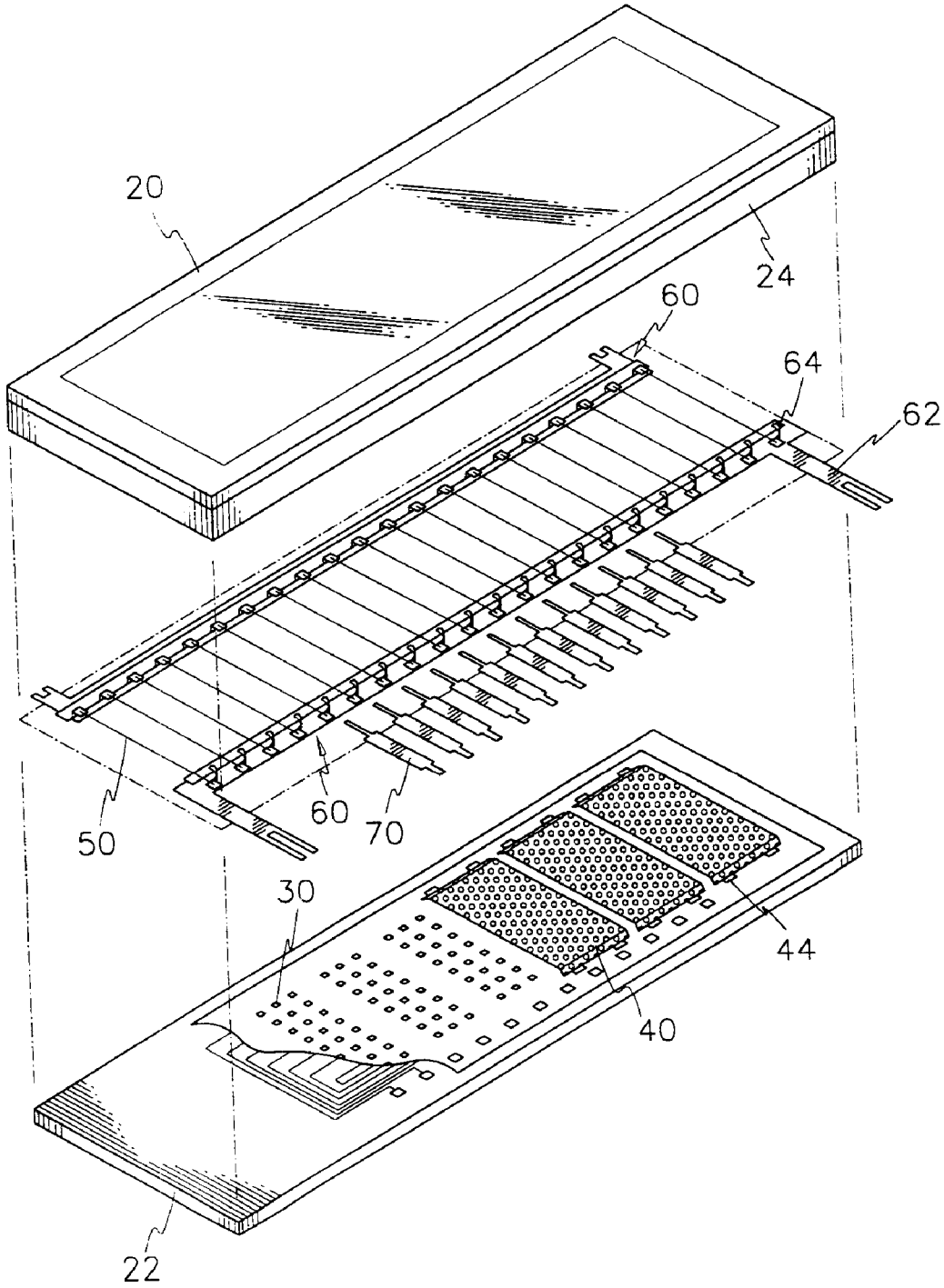
FIG. 1 is an exploded perspective view of a vacuum fluorescent display according to a preferred embodiment of the present invention.
Figure 2:
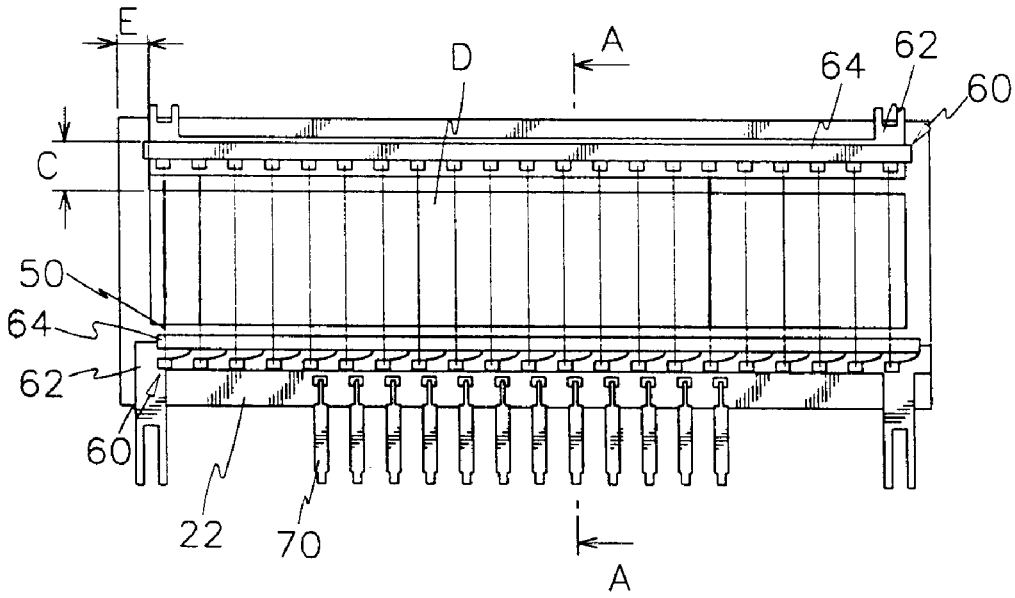
FIG. 2 is a plan view of the vacuum fluorescent display shown in FIG. 1.
Figure 3:
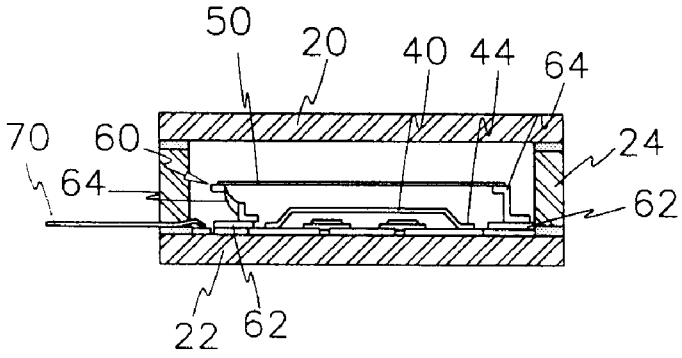
FIG. 3 is a sectional view of the vacuum fluorescent display taken along the A—A line of FIG. 2.

FIG. 1 is an exploded perspective view of a vacuum fluorescent display according to a first preferred embodiment of the present invention, FIG. 2 is a plan view of the vacuum fluorescent display shown in FIG. 1, and FIG. 3 is a sectional view of the vacuum fluorescent display taken along the A—A line of FIG. 2.

As shown in the drawings, the vacuum fluorescent display includes a transparent front glass substrate 20, a rear glass substrate 22 spaced apart from the front substrate 20 with a predetermined distance, and a side glass 24 interposed between the front glass substrate 20 and the rear glass substrate 22 while forming an inner vacuum space for receiving electrode components. The front glass substrate 20 and the rear glass substrate 22 are rectangular-shaped each with two long sides and two short sides.

A plurality of anode electrodes 30 are arranged on the rear glass substrate 22 in a predetermined pattern, and coated with phosphors. A plurality of grids 40 are mounted above the anode electrodes 30. Each of the grids 40 has side bent portions, and the side bent portions of the grid 40 are fixed at grid fixtures 44 on the rear glass substrate 22. A plurality of filaments 50 are placed above the grids 40. Each of the filaments 50 has two ends, and the ends of each filament 50 are fixed to supports 60 on the rear glass substrate 22, respectively. The supports 60 are fixed onto both of the long sides of the rear glass substrate 22, respectively. A plurality of leads 70 are fixed onto one of the long sides of the rear glass substrate 22 to be placed external to the support 60. The leads 70 are arranged to be parallel to the filaments 50.

In the above structure, the outermost portions of the pattern of the anode electrodes 30 are positioned to be adjacent to the inner wall of the side glass 24.

The support 60 includes a base 62 fixed to the rear glass substrate 22, and a filament supporting member 64 mounted onto the base 62. The filament supporting member 64 has a plurality of protruded bent portions to which the filaments 50 are welded one by one. The protruded bent portions of the filament supporting member 64 are placed above the grid fixtures 44. It is preferable that the support 60 should be electrically insulated from the grid 40.

In the above structure, the so-called end cooling zones C are present between the welding points of the filaments 50 on the filament supporting member 64 and the pattern of the anode electrodes 30. Since the grid fixtures 44 are placed within the end cooling zones C, the end cooling zones C at the long sides of the rear glass substrate 22 are not needlessly enlarged.

Furthermore, as the supports 60 are positioned at the long sides of the rear glass substrate 22 together with the leads 70, the display area D is longitudinally widened nearby up to the inner wall of the side glass 24 so that the non-use area E at the short sides of the rear glass substrate 22 can be minimized.

Figure 4:
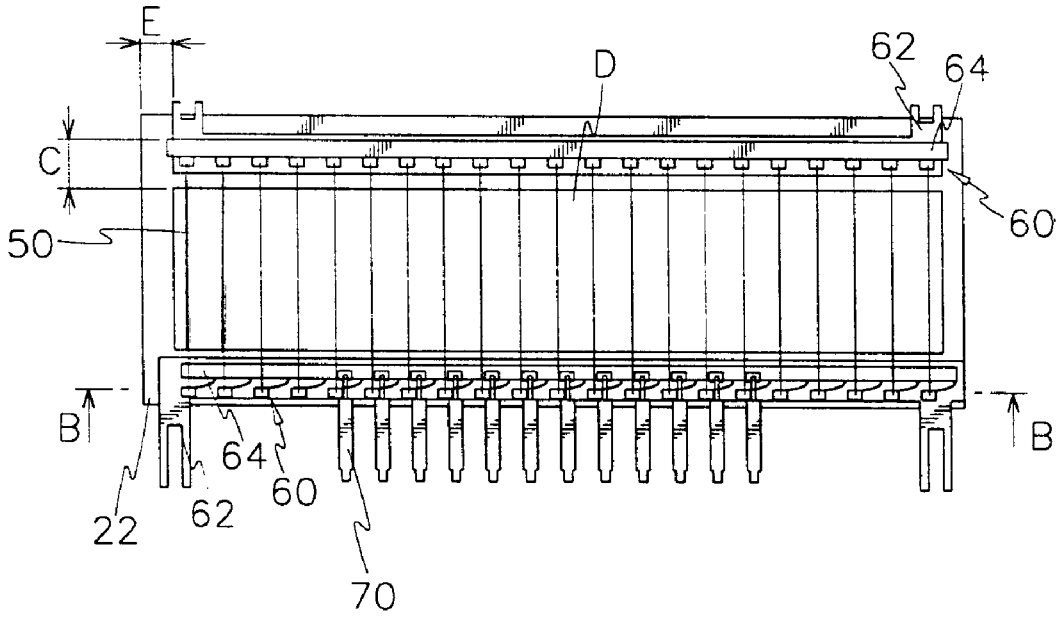
FIG. 4 is a plan view of a vacuum fluorescent display according to a second preferred embodiment of the present invention.
Figure 5:
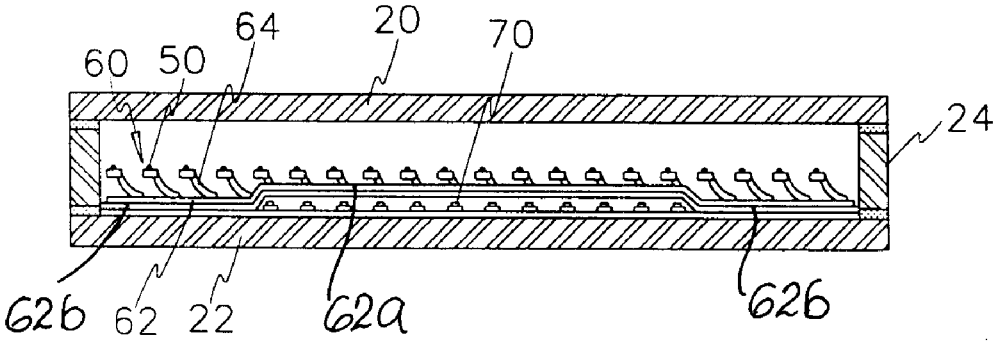
FIG. 5 is a sectional view of the vacuum fluorescent display taken along the B—B line of FIG. 4.
Figure 6:
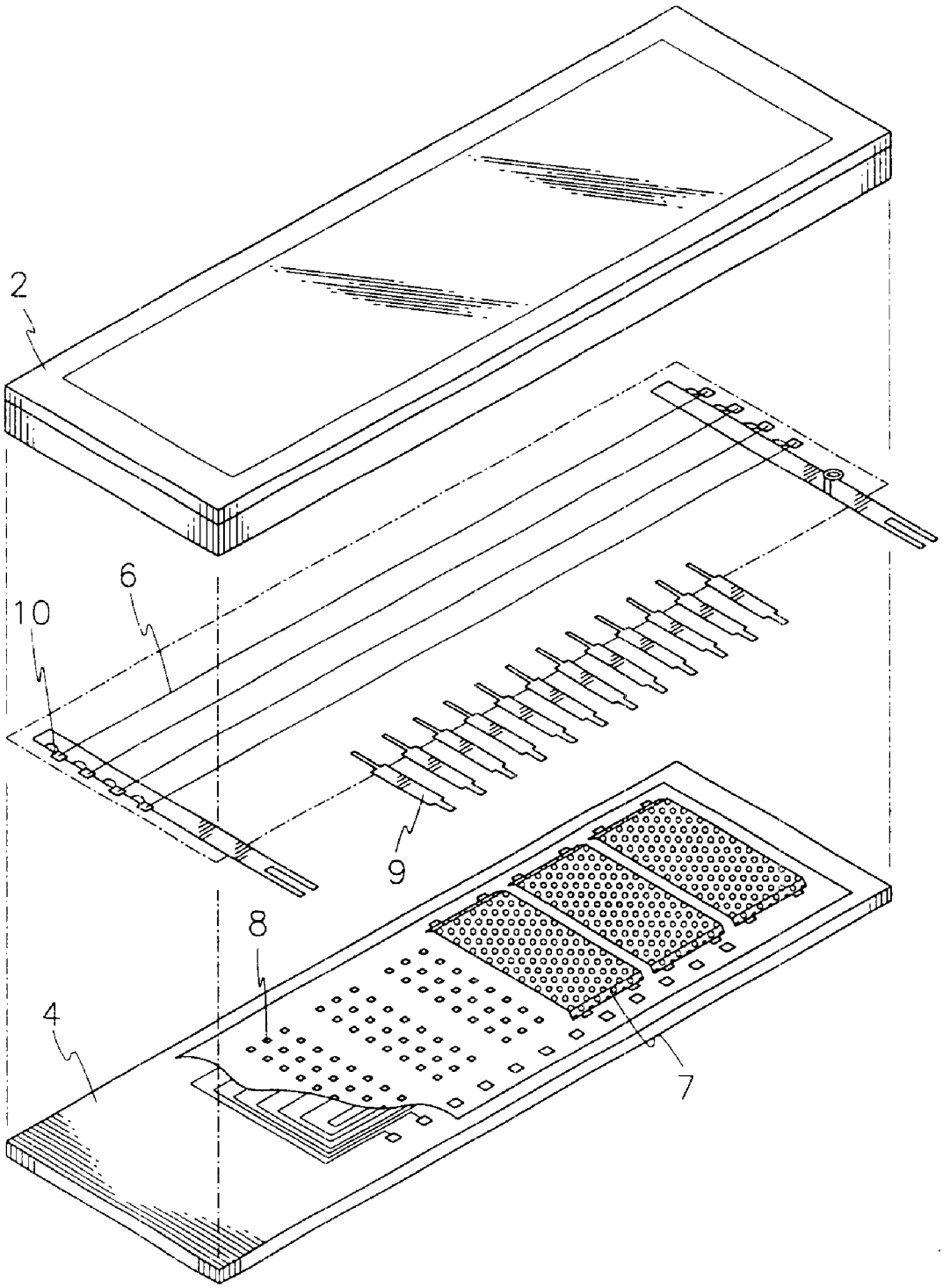
Fig. 6 (PRIOR ART)
FIG. 6 is an exploded perspective view of a vacuum fluorescent display according to a prior art.
Figure 7:
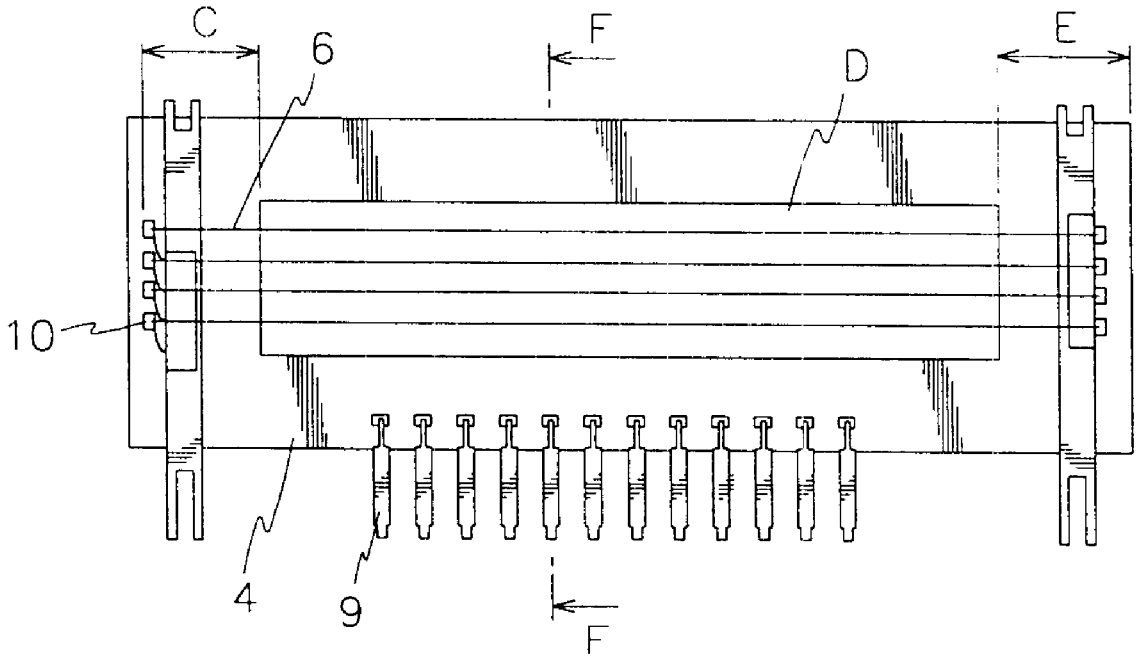
Fig.7 (PRIOR ART)
FIG. 7 is a plan view of the vacuum fluorescent display shown in FIG. 6.
Figure 8:
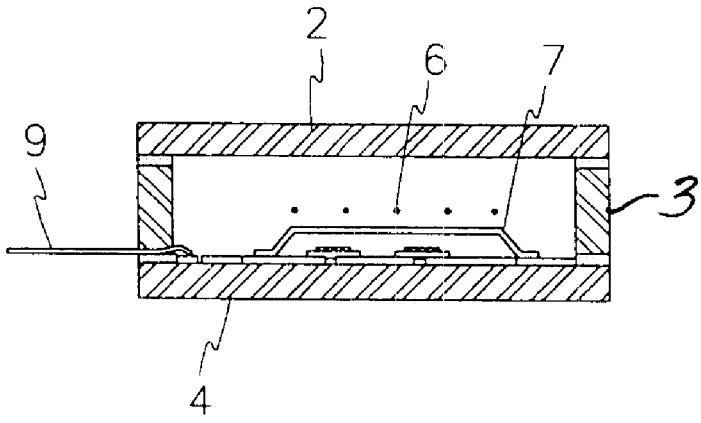
Fig.8 (PRIOR ART)
FIG. 8 is a sectional view of the vacuum fluorescent display taken along the F—F line of FIG. 7.

FIG. 4 is a plan view of a vacuum fluorescent display according to a second preferred embodiment of the present invention, and FIG. 5 is a sectional view of the vacuum fluorescent display taken along the B—B line of FIG. 4. Other components of the vacuum fluorescent display are the same as those related to the first preferred embodiment except that the filament supporting member 64 of the support 60 is, positioned above the leads 70 with a predetermined distance thereto.

Specifically, the filament supporting member 64 of the support 60 is structured to have two bent ends fixed to the base 62 such that the end portions of the leads 70 fixed to the rear glass substrate 22 can be placed just below the filament supporting member 64 between the two bent ends.

In this structure, the fixation of the leads is made within the end cooling zone C so that the display area D can be widened along both of the long and short sides of the rear glass substrate 22.

As described above, the above-structured vacuum fluorescent display can effectively increase the display area while minimizing the non-use area.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A vacuum fluorescent display comprising:

a transparent front glass substrate substantially rectangular-shaped with two long sides and two short sides;

a rear glass substrate spaced apart from the front glass substrate with a predetermined distance, the rear glass substrate being substantially rectangular-shaped with two long sides and two short sides corresponding to the long and short sides of the front glass substrate;

a side glass interposed between the front and rear glass substrates while forming an inner vacuum space;

a plurality of anode electrodes internally arranged on the rear glass substrate in a predetermined pattern, the anode electrodes being coated with phosphors;

a plurality of grids internally mounted above the anode electrodes, each grid having side bent portions, the side bent portions of the grid being fixed to the rear glass substrate such that the grid is spaced apart from the anode electrodes with a predetermined distance, the grids being fixed to the rear glass substrate via grid fixtures;

a plurality of filaments internally placed above the grids to function as electron-emitting cathode electrodes;

a plurality of leads fixed to one of the long sides of the rear glass substrate to apply voltages to the anode electrodes and the grids, the leads being arranged to be substantially parallel to the filaments; and supports fixed to both of the long sides of the rear glass substrate to support the filaments;

wherein the supports each comprise a base fixed to the rear glass substrate, and a filament supporting member mounted onto the base with protruded bent portions for the welding of the filaments, the protruded bent portions of the filament supporting member being positioned above the grid fixtures;

wherein the filament supporting member is positioned above the leads with a predetermined distance; and wherein the filament supporting member has two bent end portions, the bent end portions of the filament supporting member being fixed to the base such that end portions of the leads fixed to the rear glass substrate are placed below the filament supporting member between the bent end portions.

* * * * *